US009480308B2

(12) United States Patent
Rouhana et al.

(10) Patent No.: US 9,480,308 B2
(45) Date of Patent: Nov. 1, 2016

(54) BUCKLE-TONGUE ARRANGEMENT FOR FOUR POINT SEAT BELT SYSTEM

(75) Inventors: Stephen William Rouhana, Plymouth, MI (US); Paul George Bedewi, Ashburn, VA (US); Frank A. MacKenzie, New Haven, MI (US); Sundeep Venkat Kankanala, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 600 days.

(21) Appl. No.: 11/871,312

(22) Filed: Oct. 12, 2007

(65) Prior Publication Data

US 2009/0094810 A1 Apr. 16, 2009

(51) Int. Cl.
*A44B 11/26* (2006.01)
*A44B 11/25* (2006.01)

(52) U.S. Cl.
CPC ..... *A44B 11/2546* (2013.01); *A44B 11/2561* (2013.01); *Y10T 24/45607* (2015.01)

(58) Field of Classification Search
CPC ..... B60R 22/00; B60R 2022/27; B60R 2022/444; B60R 2022/3424; B60R 22/02; B60R 22/001; B60R 22/26; B60R 22/3413; B60R 22/40; B60R 2022/1818; B60R 2022/286; B60R 22/343; A44B 11/00; A44B 11/25; A44B 11/2511
USPC ..... 24/630, 640, 633, 631, 632; 297/484, 297/467, 468, 482; 11/630, 640, 633, 631, 11/632
See application file for complete search history.

(56) References Cited

U.S. PATENT DOCUMENTS

| | | | | |
|---|---|---|---|---|
| 2,312,946 | A * | 3/1943 | Watter | 297/484 |
| 3,784,224 | A * | 1/1974 | Peeler | 297/471 |
| 3,799,610 | A | 3/1974 | Hollins | |
| 4,099,770 | A * | 7/1978 | Elsholz et al. | 297/216.11 |
| 4,606,552 | A * | 8/1986 | Hultqvist | 280/801.1 |
| 4,638,534 | A | 1/1987 | Sasaki et al. | |
| 4,675,956 | A * | 6/1987 | Cohen | 24/657 |
| 4,826,246 | A * | 5/1989 | Meeker | 297/256.15 |
| 5,286,090 | A * | 2/1994 | Templin et al. | 297/473 |
| 5,398,997 | A * | 3/1995 | McFalls | 297/476 |
| 5,580,126 | A | 12/1996 | Sedlack | |
| 5,584,107 | A * | 12/1996 | Koyanagi et al. | 24/632 |
| 5,813,097 | A | 9/1998 | Woellert et al. | |
| 5,839,793 | A * | 11/1998 | Merrick et al. | 297/484 |
| 5,873,635 | A * | 2/1999 | Merrick | 297/484 |
| 5,899,534 | A * | 5/1999 | Gray | 297/484 |
| 6,260,925 | B1 * | 7/2001 | Miller | 297/467 |
| 6,328,386 | B1 * | 12/2001 | Good | 297/483 |
| 6,367,129 | B1 * | 4/2002 | Mori | 24/641 |
| 6,367,882 | B1 * | 4/2002 | Van Druff et al. | 297/484 |
| 6,463,638 | B1 | 10/2002 | Pontaoe | |

(Continued)

*Primary Examiner* — Robert J Sandy
*Assistant Examiner* — Rowland Do
(74) *Attorney, Agent, or Firm* — LeClairRyan

(57) ABSTRACT

A four-point seat belt system for restraining a vehicle occupant in a vehicle seat is disclosed. The system includes a four-point seat belt restraint system mounted on a vehicle seat that includes a first lap belt portion having a back side and a second lap belt portion having a back side. A portion of at least one of the back side of the first lap belt portion or the back side of the second lap belt portion has a contour which substantially corresponds to the contour of the lap of the seated vehicle occupant. The contour is defined by a convex surface. Each of the buckle portion and the tongue portion may include a button release.

7 Claims, 6 Drawing Sheets

(56) References Cited

U.S. PATENT DOCUMENTS

| | | | | |
|---|---|---|---|---|
| 6,513,208 | B1 * | 2/2003 | Sack et al. | 24/632 |
| 6,543,101 | B2 * | 4/2003 | Sack et al. | 24/633 |
| 6,591,465 | B2 * | 7/2003 | Suyama | 24/633 |
| 6,662,413 | B2 * | 12/2003 | Glover | 24/615 |
| 6,719,326 | B2 | 4/2004 | Schroth et al. | |
| 6,837,547 | B2 | 1/2005 | Delventhal et al. | |
| 6,871,876 | B2 * | 3/2005 | Xu | 280/801.1 |
| 7,263,750 | B2 * | 9/2007 | Keene et al. | 24/638 |
| 7,516,711 | B2 * | 4/2009 | Messner et al. | 112/475.01 |
| 7,533,901 | B2 * | 5/2009 | David et al. | 280/801.1 |
| 7,625,048 | B2 * | 12/2009 | Rouhana et al. | 297/484 |
| 2002/0089163 | A1 * | 7/2002 | Bedewi et al. | 280/801.1 |
| 2002/0178557 | A1 * | 12/2002 | Katsuyama et al. | 24/633 |
| 2003/0098575 | A1 * | 5/2003 | Schroth et al. | 280/808 |
| 2004/0012242 | A1 | 1/2004 | White | |
| 2004/0207245 | A1 * | 10/2004 | Baylis | 297/481 |
| 2004/0255438 | A1 | 12/2004 | Benedict | |
| 2004/0255439 | A1 * | 12/2004 | Benedict | 24/640 |
| 2005/0073187 | A1 | 4/2005 | Frank et al. | |
| 2005/0082815 | A1 | 4/2005 | Frank et al. | |
| 2005/0121897 | A1 | 6/2005 | Elizondo et al. | |
| 2005/0121967 | A1 * | 6/2005 | Crowl | 297/482 |
| 2005/0225157 | A1 | 10/2005 | Patrizi et al. | |
| 2006/0213040 | A1 * | 9/2006 | Benedict | 24/633 |
| 2007/0044285 | A1 * | 3/2007 | Kawamura et al. | 24/633 |
| 2009/0115180 | A1 * | 5/2009 | Miyagawa | 280/808 |
| 2009/0178254 | A1 * | 7/2009 | Messner et al. | 24/633 |

* cited by examiner

BUCKLE-TONGUE ARRANGEMENT FOR FOUR POINT SEAT BELT SYSTEM

TECHNICAL FIELD

A buckle-tongue arrangement for a seat belt system of a four-point design is provided. Particularly, a buckle-tongue arrangement is provided for use with a four-point design seat belt system in which the occupant-facing surface of the buckle-tongue assembly is provided with a convex surface or other suitable surface which is contoured to comfortably interface with the occupant's lap.

BACKGROUND OF THE INVENTION

Automotive vehicles incorporate a variety of restraint systems to provide for the safety of vehicle occupants. For example, it is known in the vehicle art to provide various types of seat belts or restraint systems for restraining an occupant in his or her seat and providing controlled deceleration of portions of the body to limit the forces applied to the occupant's body during rapid deceleration of a vehicle from a cause such as a collision. Various types of seat belts and restraint systems have been used in automobiles, trucks, and other vehicles and are commonly known today.

Known seat belt systems typically used in commercially available production vehicles are three-point restraint systems with a lap belt and a shoulder belt extending over one shoulder of the occupant and connecting with the lap belt. The lap belts are anchored at one end to the seat or to the vehicle adjacent the seat. The shoulder belts are connected at one end to the vehicle or to the seat and at the other end to the lap belt or lap belt buckle mechanism. An additional fifth belt in the form of a crotch strap is occasionally provided in conjunction with such systems.

For all of the known advantages of four-point systems in vehicles, the actual use by the occupant of such systems could be compromised because of lack of buckle comfort. The discomfort may arise as a result of contact between the buckle-tongue assembly cover and the occupant's lap. The potential decrease in comfort could result in a decline in seat belt usage rates in vehicles equipped with four-point belt systems.

In addition, known four-point systems may be challenging for the occupant to release in that known release buttons for such systems are inconveniently positioned. An occupant wearing a four-point belt system in a vehicle may want to, driven either by convenience or by habit, unbuckle the belt system (that is, release the latched buckle) from either the right hand side or the left hand side of the buckle. Currently, belt systems can be unbuckled by release buttons located only on one side of the buckle.

Accordingly, a need exists today for an improved four-point seat belt system for use in vehicles that provides a comfortable fit as well as a convenient and efficient mechanism for releasing the buckle.

SUMMARY OF THE INVENTION

The disclosed embodiments of the invention provide a four-point seat belt restraint system mounted on a vehicle seat that includes a first lap belt portion having a buckle and a second lap belt portion having a tongue. The first lap belt and the second lap belt are releasably attachable. A portion of at least one of the back side of the buckle of the first lap belt portion or the back side of the tongue of the second lap belt portion has a contour which substantially corresponds to the contour of the lap of the seated vehicle occupant and thus maximizes the contact surface between the buckle-tongue assembly and the occupant's lap while minimizing localized or concentrated loading. The contour, whether on one or both of the buckle or tongue portions, is defined by a convex surface or other surface geometry, including concave. Regardless of the embodiment, each of the buckle portion and the tongue portion may include a button release. The buckle-tongue assembly may further include a first shoulder belt attached to the first lap portion and a second shoulder belt attached to the second lap portion. In addition, a crotch strap may be provided if a five-point restraint system is desired.

Other features of the invention will become apparent when viewed in light of the detailed description of the preferred embodiment when taken in conjunction with the attached drawings and the appended claims.

BRIEF DESCRIPTION OF THE DRAWINGS

For a more complete understanding of this invention, reference should now be made to the embodiment illustrated in greater detail in the accompanying drawings and described below by way of examples of the invention wherein.

DETAILED DESCRIPTION OF THE PREFERRED EMBODIMENT

Figure 1:
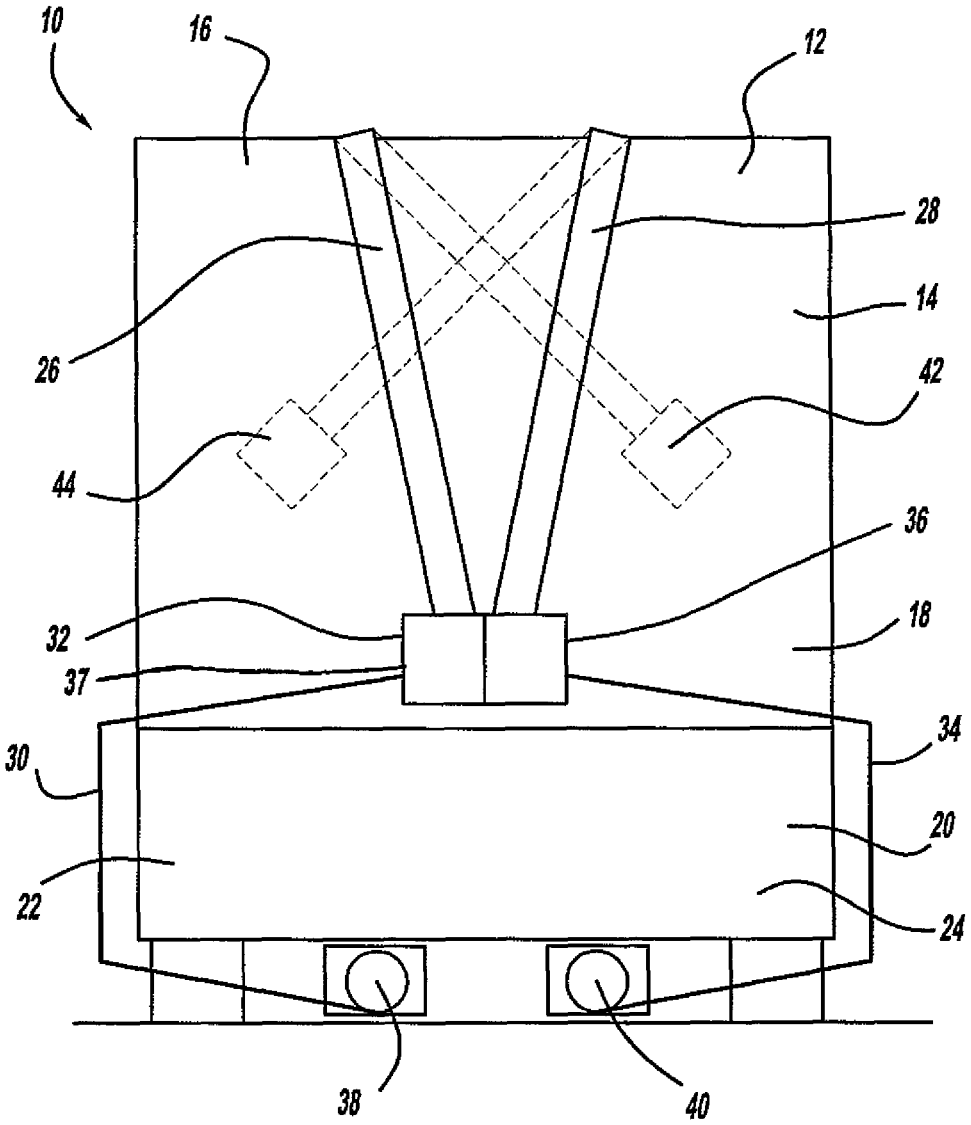
FIG. 1 illustrates a front view of a four-point seat belt restraint system in an in-use position shown without an occupant according to a first embodiment of the invention.

In the following figures, the same reference numerals will be used to refer to the same components. In the following description, various operating parameters and components are described for one constructed embodiment. These specific parameters and components are included as examples and are not meant to be limiting.

Referring to the drawings and in particular to FIG. 1, one embodiment of a buckle-tongue and belt system for a four-point seat belt restraint arrangement, generally illustrated as 10, is shown. A seat 12, typically for use in an automotive vehicle (not shown), includes a generally upright seat back 14 extending between a top portion 16 and a bottom portion 18 for supporting the back of a seated occupant. The seat 12 further includes a generally horizontal seat cushion 20 projecting forwardly from the bottom portion 18 of the seat back 14 and extending between an inboard or right side 22 and an outboard or left side 24 for supporting the bottom of the seated occupant. The inboard side 22 is further defined by the side of the seat 12 adjacent the inboard or middle of the vehicle and the outboard side 24 is further defined by the side of the seat 12 adjacent the outboard or outside of the vehicle as is commonly known in the art.

The buckle-tongue and belt system 10 includes a first, or inboard shoulder belt webbing 26 extending from the top portion 16 to the bottom portion 18 of the seat back 14 adjacent the inboard side 22 of the seat cushion 20. The system 10 further includes a second, or outboard, shoulder belt webbing 28 extending from the top portion 16 to the bottom portion 18 of the seat back 14 adjacent the outboard side 24 of the seat cushion 20. The system 10 further includes a first, or inboard, lap belt webbing 30 extending from the inboard side 22 of the seat cushion 20 to a buckle component 32 and a second, or outboard, lap belt webbing 34 extending from the outboard side 24 of the seat cushion 20 to a tongue component 36. It is to be understood that the buckle component 32 can be either a buckle or a tongue and the tongue component 36 can be either a tongue or a buckle. References made to these elements are made with this interchangeability in mind. Collectively the buckle component 32 and the tongue component 36 define a buckle-tongue assembly 37.

The first lap belt webbing 30 is anchored to the seat 12 by a retractor 38. The retractor 38 is anchored to the seat 12 by fasteners including bolts, welds and the like. The second lap belt webbing 34 is anchored to the seat 12 by a retractor 40, also attached to the seat 12 by the mentioned fasteners. It is to be understood that while the retractors 38 and 40 are shown attached to the underside of the seat 12 the retractors 38 and 40 could readily be attached elsewhere on the seat. Preferably but not necessarily the retractors 38 and 40 include dynamic and/or static pretensioning features. In addition, the retractors 38 and 40 may alternatively be attached to the vehicle floor and other body structures.

The first shoulder belt webbing 26 may be fixed or may be releasably attachable to the buckle component 32 and the second shoulder belt webbing 28 may be releasably attachable to the tongue component 36. The buckle component 32 may be fixed or may be releasably attachable to the tongue component 36. (By allowing for the possibility of releasable attachment of the belt webbing to the buckle component ease of both assembly and service may be enhanced.) This arrangement results in the illustrated V-shape defined by the substantial convergence of the first shoulder belt webbing 26 and the second shoulder belt webbing 28 at the buckle component 32 and the tongue component 36.

The first shoulder belt webbing 26 is anchored to the seat 12 by a retractor 42 that is fixedly secured to the seat 12 by fasteners including bolts, welds and the like. The second shoulder belt webbing 28 is anchored to the seat 12 by a retractor 44 which is also fixedly secured to the seat 12 by the noted fasteners. It is to be understood that the retractors may alternatively be attached to a body structure adjacent to the seat 12 as is known in the art. The retractors 42 and 44 are preferably but not necessarily equipped with load-limiting features which may be of the single or multiple level and discrete or continuous type as is known in the art. Load limiting offers the advantages of enhancing control of the occupant's upper torso kinematics, and limiting the tension load applied by the shoulder belt to the lap belt, approximately limiting the load transferred by the restraint system to the upper torso, thus helping to minimize submarining in an impact event. The dynamic and static load pretensioners described above with respect to the retractors 38 and 40 combines with this load limiting feature to assist in minimizing submarining. Pre-impact tensioning is useful in reducing slack prior to an impact which in turn may improve occupant coupling to the seat and to the restraint system.

As illustrated in FIG. 1, the retractor 42 is positioned on the seat back at a location that is on the side opposite that of the first shoulder belt webbing 26. The retractor 44 is also positioned on the seat back at a location that is on the side opposite that of the second shoulder belt webbing 28. This arrangement defines a crossed pattern that allows for the desired belt, orientation and belt angles relative to the occupant's shoulder and was determined from testing with human volunteers to improve comfort. The first shoulder belt webbing 26 and the second shoulder belt webbing 28 follow over the top of the seat 12 and provide a change of direction without twisting or folding at the top of the seat back. This arrangement also provides for enhanced occupant comfort and performance in that the first shoulder belt webbing 26 and the second shoulder belt webbing 28 are able to lie more naturally on the curve of the occupant's shoulder.

Figure 2:
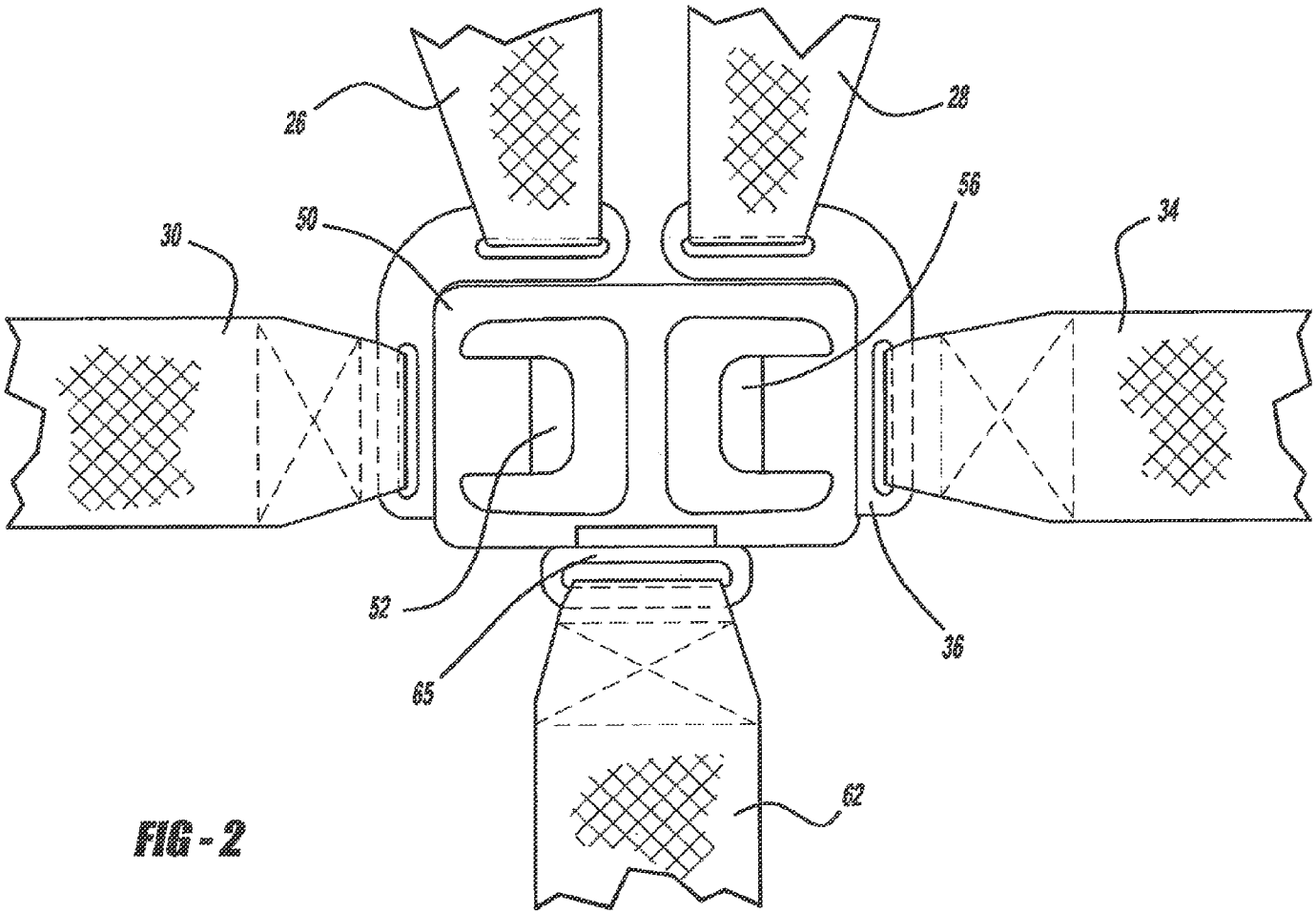
FIG. 2 illustrates a detailed front view of a detailed view of the buckle-tongue assembly of the four-point seat belt restraint system shown in FIG. 1 shown in its connected or buckled state along with the optional crotch strap or firth point.

With reference to FIG. 2, a detailed view of the buckle-tongue assembly 37 is shown in its connected or buckled state. The buckle-tongue assembly 37 is illustrated as having a particular configuration, but it is to be understood that the configuration shown is not intended as being limiting but rather is intended as being illustrative only.

As set forth above, the buckle-tongue assembly 37 of the present invention includes a buckle component 32 and a tongue component 36. Also as set forth above, the element 32 could be the tongue component and the element 36 could be the buckle component. The buckle component 32 has a front surface 50 on which a first buckle release button 52 and a second buckle release button 56 are provided. Fitted with a dual release system, the occupant (not shown) has the option of pressing the buckle release button 52 or the buckle release button 56 to enable release of the buckle component 32 from the tongue component 36 thereby providing maximum versatility of the assembly and maximum ease of release to the occupant. According to the described and illustrated design, a right-handed occupant is able to release the latched buckle from the right hand side and a left-handed occupant is able to release the latched buckle from the left hand side, thus providing the occupant of a four-point belt system with superior ease of use. The release buttons 52 and 56 could be positioned elsewhere on the components such as on the tops or on the sides. The only requirement is that the two or more belts are buckled in front of the occupant.

Figure 3:
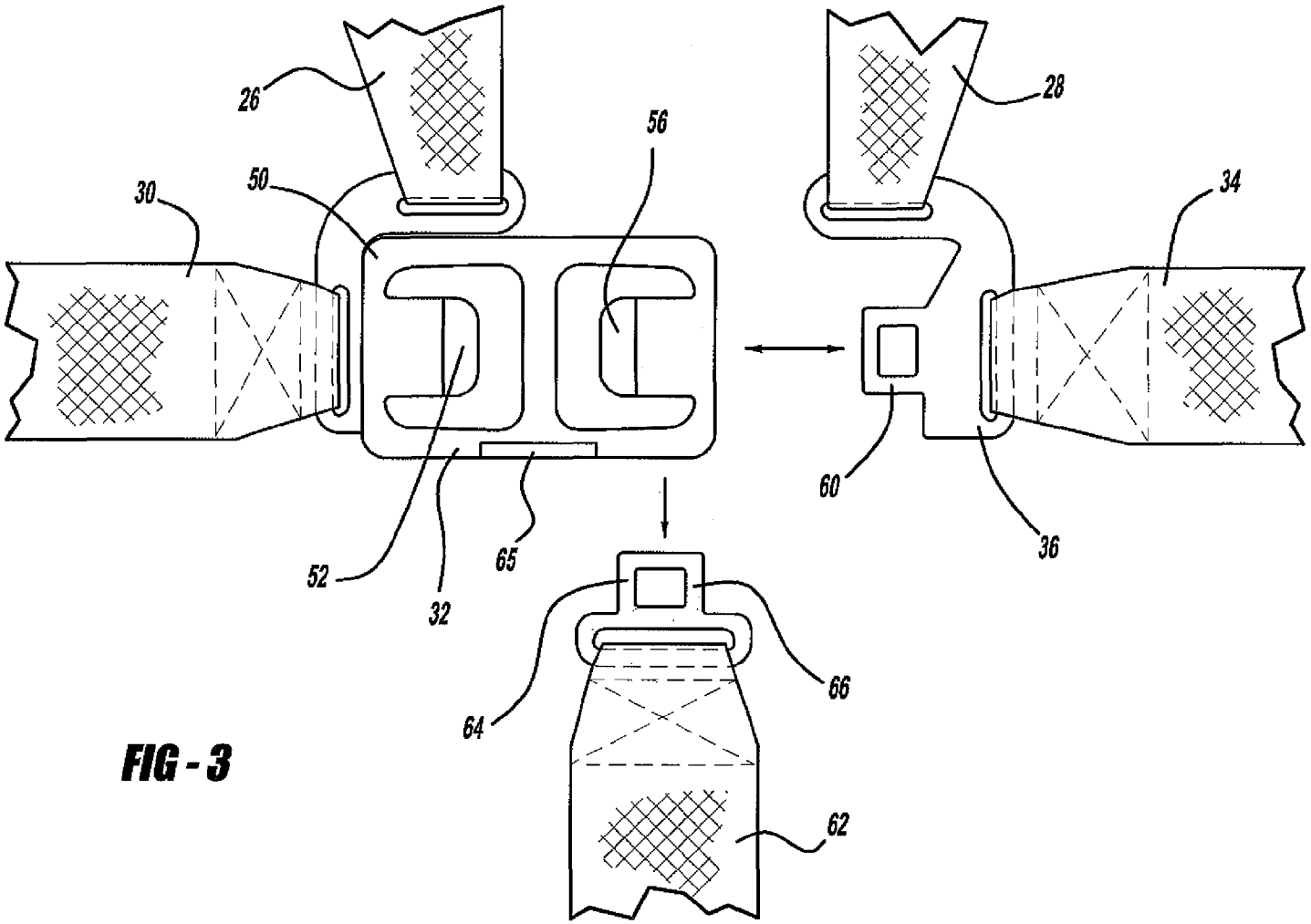
FIG. 3 is a view similar to that of FIG. 2 but showing some of the elements in their disconnected or unbuckled state.

FIG. 3 is a view similar to that of FIG. 2 but illustrates some of the elements of the buckle-tongue assembly 37 in their disconnected or unbuckled state. Referring to both FIGS. 2 and 3, a tongue 60 is shown extending from the tongue component 36 and may be releasably inserted into a slot (not shown) defined in the buckle component 32.

An optional crotch strap 62 may be provided for the case of a five-point seat belt system. By providing an optional crotch strap 62 the user is given the option of using either a 5-point configuration or a 4-point configuration. The crotch strap 62 may be adjustable and may be connected to a rigid anchor or a retractor. The crotch strap 62 includes a tongue component 64 having a tongue element 66. The tongue element 66 is respectively releasably insertable into the buckle component 32. Release of the tongue element 66 of the tongue component 64 is accomplished by a wearer pressing upon the release button 65.

Figure 4:
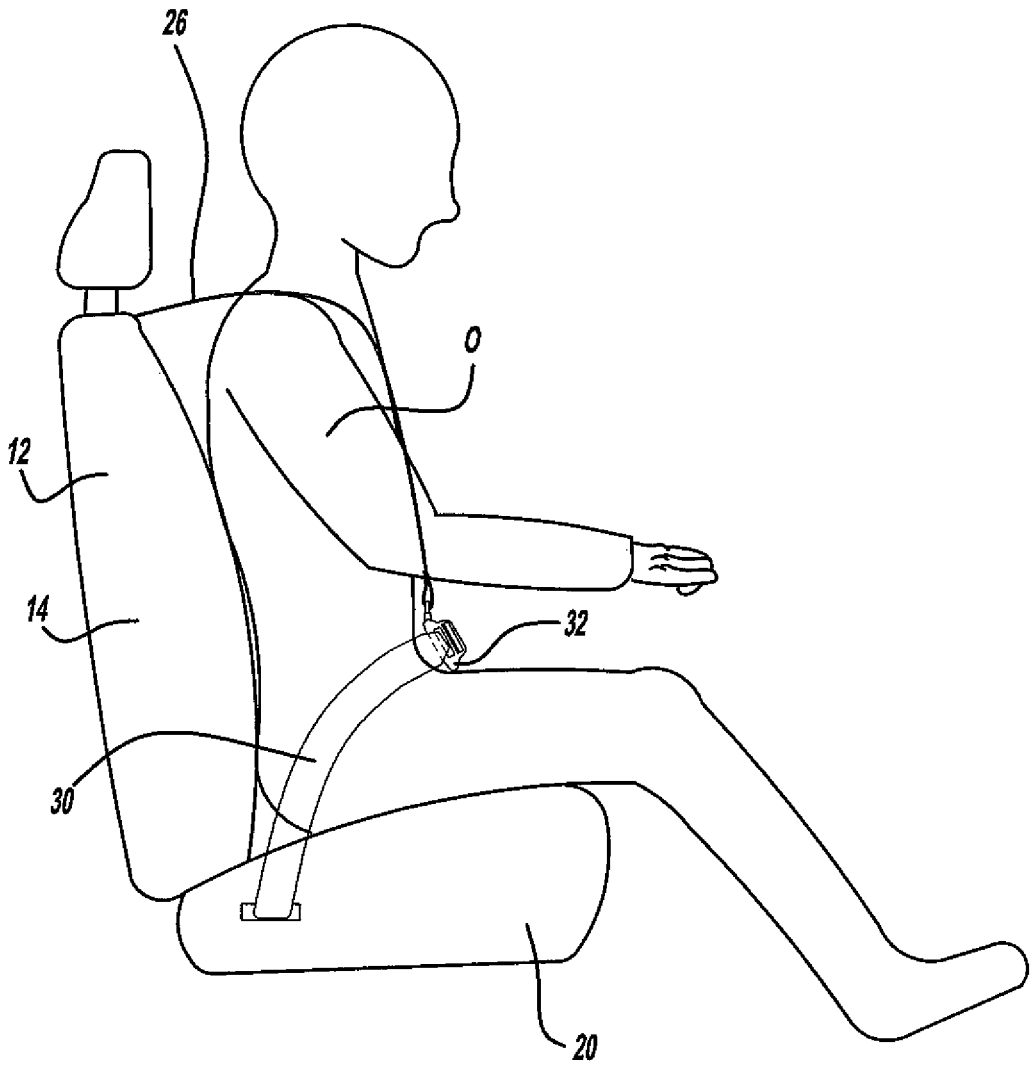
FIG. 4 is a side view of a seated occupant wearing the four-point seat belt restraint system disclosed herein.

As set forth above, an object of the disclosed invention is to provide an improvement in occupant comfort while the four-point seat belt (or five-point seat belt, as the case may be) is worn. Reference is accordingly made to FIG. 4 in which an occupant (generally illustrated as "O") is shown seated in the seat 12 and to FIG. 5 which illustrates a detailed side view of the buckle-tongue assembly 37. The lap of the seated occupant "O" generally defines a contoured area which may be any of various shapes including but not limited to convex or concave. The backs of known buckle-tongue assemblies are substantially flat and thus do not follow the contour of the occupant's lap to any degree. As shown particularly in FIG. 5, the invention set forth herein addresses this problem by providing a buckle-tongue assembly that comfortably interfaces with the occupant's lap by maximizing the contact surface between the back of the buckle-tongue assembly 37 and the occupant's lap.

Figure 5:
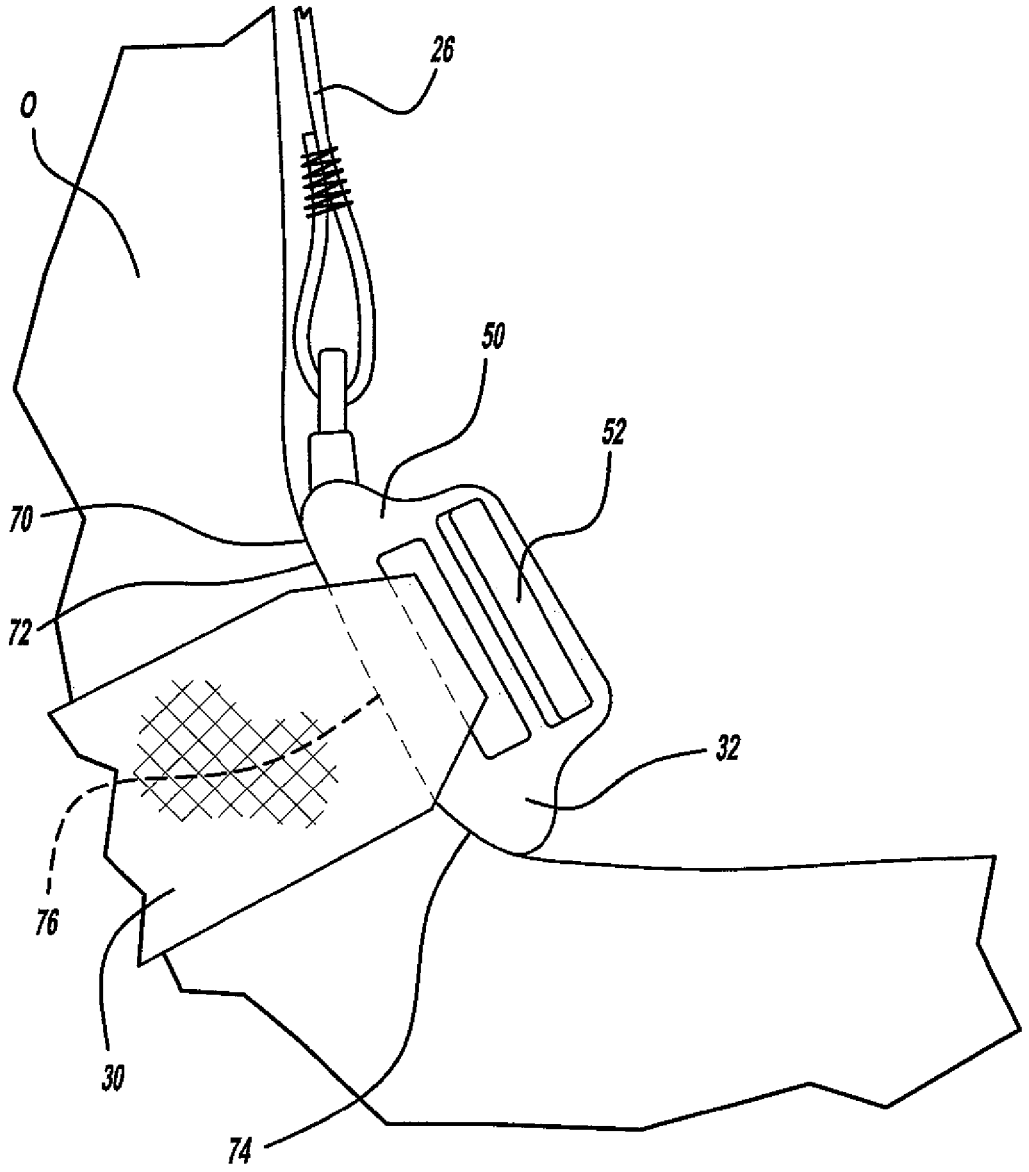
FIG. 5 illustrates a detailed side view of the buckle-tongue assembly in place on the lap of a seated occupant.

Particularly, and referring to FIG. 5, the cover of the buckle component 32 includes a back side 70 which has an upper end 72 and a lower end 74. Between the upper end 72 and the lower end 74 is defined a contoured surface 76 which substantially follows the contour of the concave area of the occupant "O" and thus minimizes localized loading on the occupant's lap by the back of the buckle component 32. All or part of the contoured area could be composed of a padding material. It should be noted that the illustrated convex configuration is used for illustrative purposes only and other configurations may be possible provided that the alternative configuration achieves the desired goal of minimizing localized loading on the occupant's lap by the back side of the buckle component 32. It should also be noted that while the convex configuration of the back 70 of the buckle component 32 is illustrated and has been discussed, a concave configuration could additionally or alternatively be provided on the back of the tongue component 36.

Figure 6:
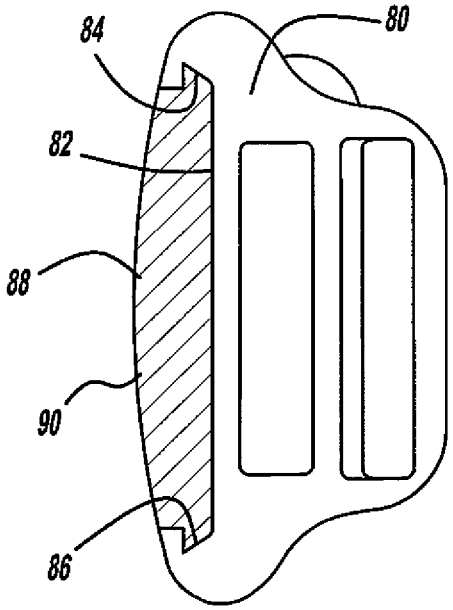
FIG. 6 illustrates a sectional view of the buckle component according to an alternate configuration including an interchangeable contour element.
Figure 7:
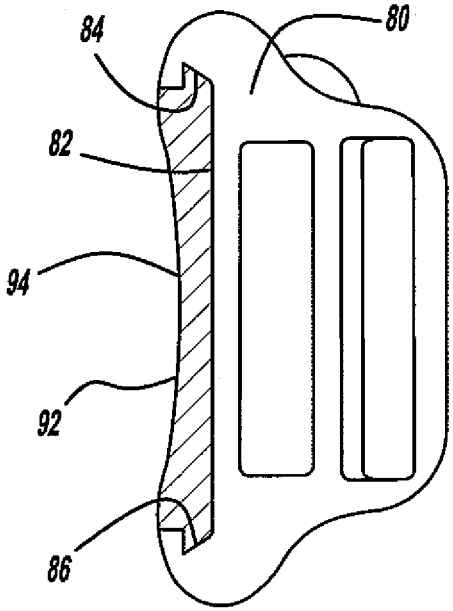
FIG. 7 illustrates a sectional view of the buckle component similar to that of FIG. 6 but showing an alternate interchangeable contour element.

To accommodate occupants having different abdomen profiles, the buckle-tongue arrangement of the present invention may be modified to include an interchangeable occupant-contacting contour element. Particularly, and with respect to FIGS. 6 and 7, an optional arrangement is illustrated in which a buckle component 80 is provided with a component-receiving area 82 having an upper slot 84 and a lower slot 86. Referring to FIG. 6, an interchangeable contour element 88 having a convex surface 90 is shown in place on the buckle component 80. The interchangeable contour element 88 is held in place by the upper slot 84 and the lower slot 86 as is known in the art or by some other means of fastening including but not limited to mechanical or chemical fastening elements. Referring to FIG. 7, an interchangeable contour element 92 having a concave surface 94 is shown in place on the buckle component 80. The interchangeable contour elements 88 and 92 are held in place by the upper slot 84 and the lower slot 86 as is known in the art or by some other means of fastening including but not limited to mechanical or chemical fastening elements. The interchangeable contour elements 88 and 92 may be composed entirely or partially of a padding material.

Removal and replacement of one element for the other depending on the particular configuration of the occupant is readily managed by sliding one contour element out of position and another contour element into position. While simple convex and concave contours are illustrated, it is to be understood that other surface geometries are possible, as is the case with the back side of the buckle 32 illustrated in the figures and discussed in relation thereto. In addition, while a slotted arrangement is provided which allows for the sliding removal and replacement of the contour element is illustrated, other approaches to removal and replacement of a contour element are possible.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A seat belt assembly for restraining an occupant in a vehicle seat, the seat belt assembly comprising:

a tongue-receiving buckle having an occupant-facing side, a top, a bottom that generally opposes the top, a first side, and a second side that generally opposes the first side, the occupant-facing side including a component-receiving area having a first slot and a second slot;

a tongue that is releasably attachable to the tongue-receiving buckle by insertion of said tongue into the second side of said tongue-receiving buckle:

one or the other of first and second interchangeable occupant-contacting contour elements, said elements being removably insertable into the component-receiving area and held in position by the first slot and the second slot, said first interchangeable occupant-contacting contour element including a convex surface; and said second interchangeable occupant-contacting contour element being removably insertable into the component-receiving area and is held in position by the first slot and the second slot, said second interchangeable occupant-contacting contour element including a concave surface.

2. The seat belt assembly of claim 1 wherein said tongue has an occupant-facing side and wherein both said occupant-facing side of said buckle and said occupant-facing side of said tongue define a convex surface.

3. The seat belt assembly of claim 1 including a first lap belt portion, a first shoulder belt portion, a second lap belt portion, a second shoulder belt portion, and a crotch belt portion, said assembly further including a crotch belt release button which may be manipulated by a wearer to effect independent release of said crotch belt.

4. The seat belt assembly of claim 1 further including a first shoulder belt attached to said buckle and a second shoulder belt attached to said tongue.

5. The seat belt assembly of claim 1 further including a first user-operated release button and a second user-operated release button and wherein said first user-operated release button is oriented towards the first side and the second user-operated release button is oriented towards the second side.

6. The seat belt assembly of claim 5 wherein the first user-operated release button is oriented for right-hand usage and the second user-operated release button is oriented for left-hand usage.

7. The seat belt assembly of claim 6 wherein at least one of the first said user-operated release button and the second user-operated release button is a release element taken from the group consisting of mechanical releases and electromechanical releases.

* * * * *